US010140951B2

(12) United States Patent
Mazzola

(10) Patent No.: US 10,140,951 B2
(45) **Date of Patent: *Nov. 27, 2018**

(54) USER INTERFACE DISPLAY COMPOSITION WITH DEVICE SENSOR/STATE BASED GRAPHICAL EFFECTS

(71) Applicant: Futurewei Technologies, Inc., Plano, TX (US)

(72) Inventor: Anthony Mazzola, Ramona, CA (US)

(73) Assignee: Futurewei Technologies, Inc., Plano, TX (US)

( * ) Notice: Subject to any disclaimer, the term of this patent is extended or adjusted under 35 U.S.C. 154(b) by 38 days.

This patent is subject to a terminal disclaimer.

(21) Appl. No.: 15/221,267

(22) Filed: Jul. 27, 2016

(65) Prior Publication Data

US 2016/0335987 A1 Nov. 17, 2016

Related U.S. Application Data

(63) Continuation of application No. 13/633,710, filed on Oct. 2, 2012, now Pat. No. 9,430,991.

(51) Int. Cl.
*G09G 5/00* (2006.01)
*G09G 5/02* (2006.01)
(Continued)

(52) U.S. Cl.
CPC ..... *G09G 5/026* (2013.01); *G09G 5/37* (2013.01); *G09G 5/377* (2013.01); *G09G 5/397* (2013.01);
(Continued)

(58) Field of Classification Search
None
See application file for complete search history.

(56) References Cited

U.S. PATENT DOCUMENTS 5,574,836 A 11/1996 Broemmelsiek
6,118,427 A 9/2000 Buxton et al.
(Continued)

FOREIGN PATENT DOCUMENTS

CN 1849804 A 10/2006
CN 101729670 A 6/2010
(Continued)

OTHER PUBLICATIONS

Foreign Communication From a Counterpart Application, European Application No. 13843655.5, European Office Action dated Sep. 7, 2017, 6 pages.
(Continued)

*Primary Examiner* — M Good Johnson
(74) *Attorney, Agent, or Firm* — Conley Rose, P.C.

(57) ABSTRACT

A method comprising receiving sensor data from a sensor, obtaining image data from a graphical effects shader based on the sensor data, blending the image data with a plurality of application surfaces to create a blended image, and transmitting the blended image to a display. The method may further comprise blending a color image with the blended image in response to a reduction in ambient light. Also disclosed is a mobile node (MN) comprising a sensor configured to generate sensor data, a display device, and a processor coupled to the sensor and the device display, wherein the processor is configured to receive the sensor data, obtain image data generated by a graphical effects shader based on the sensor data, blend the image data with an application surface associated with a plurality of applications to create a blended image, and transmit the blended image to the display.

20 Claims, 13 Drawing Sheets
(3 of 13 Drawing Sheet(s) Filed in Color)

(51) Int. Cl.

| | |
|---|---|
| ***G09G 5/37*** | (2006.01) |
| ***G09G 5/397*** | (2006.01) |
| ***G09G 5/377*** | (2006.01) |
| *G09G 5/14* | (2006.01) |

(52) U.S. Cl.

CPC ..... *G09G 5/00* (2013.01); *G09G 5/02* (2013.01); *G09G 5/14* (2013.01); *G09G 2320/0626* (2013.01); *G09G 2320/0666* (2013.01); *G09G 2320/08* (2013.01); *G09G 2320/10* (2013.01); *G09G 2340/045* (2013.01); *G09G 2340/10* (2013.01); *G09G 2340/14* (2013.01); *G09G 2360/144* (2013.01)

(56) References Cited

U.S. PATENT DOCUMENTS

| | | | | |
|---|---|---|---|---|
| 6,317,128 | B1 | 11/2001 | Harrison et al. | |
| 6,549,218 | B1 | 4/2003 | Gershony et al. | |
| 6,654,501 | B1 | 11/2003 | Acharya et al. | |
| 7,168,048 | B1 | 1/2007 | Goossen et al. | |
| 7,327,376 | B2 | 2/2008 | Shen et al. | |
| 7,614,011 | B2 | 11/2009 | Karidis et al. | |
| 7,724,258 | B2 * | 5/2010 | Ebert | G06T 13/60 345/419 |
| 7,730,413 | B1 | 6/2010 | Engel et al. | |
| 8,120,623 | B2 | 2/2012 | Lee et al. | |
| 8,125,495 | B2 | 2/2012 | Darsa et al. | |
| 8,154,527 | B2 | 4/2012 | Ciesla et al. | |
| 8,207,983 | B2 * | 6/2012 | Taneja | G09G 5/397 345/501 |
| 8,291,332 | B2 | 10/2012 | Chaudhri et al. | |
| 8,533,624 | B2 | 9/2013 | Chaudhri et al. | |
| 8,635,545 | B2 | 1/2014 | Kim et al. | |
| 8,860,653 | B2 | 10/2014 | Mahowald et al. | |
| 9,105,110 | B2 * | 8/2015 | DuBois | G06T 3/60 |
| 9,294,612 | B2 | 3/2016 | Naftolin | |
| 2006/0087502 | A1 | 4/2006 | Karidis et al. | |
| 2007/0070076 | A1 | 3/2007 | Foxenland | |
| 2008/0030464 | A1 | 2/2008 | Sohm et al. | |
| 2008/0204424 | A1 | 8/2008 | Jin et al. | |
| 2008/0218501 | A1 | 9/2008 | Diamond | |
| 2009/0174624 | A1 | 7/2009 | Shu et al. | |
| 2009/0262122 | A1 | 10/2009 | Darsa et al. | |
| 2009/0309711 | A1 | 12/2009 | Adappa et al. | |
| 2010/0045619 | A1 | 2/2010 | Birnbaum et al. | |
| 2010/0098326 | A1 * | 4/2010 | Abeloe | H04N 21/235 382/154 |
| 2010/0105442 | A1 | 4/2010 | Yoo | |
| 2010/0153313 | A1 | 6/2010 | Baldwin et al. | |
| 2010/0201709 | A1 * | 8/2010 | Yang | H04N 5/58 345/629 |
| 2011/0007086 | A1 | 1/2011 | Kim et al. | |
| 2011/0022958 | A1 | 1/2011 | Kang et al. | |
| 2011/0041086 | A1 | 2/2011 | Kim et al. | |
| 2011/0246916 | A1 * | 10/2011 | Leskela | G06F 3/0488 715/765 |
| 2012/0036433 | A1 | 2/2012 | Zimmer et al. | |
| 2012/0162261 | A1 | 6/2012 | Kim et al. | |
| 2012/0242852 | A1 * | 9/2012 | Hayward | H04N 5/23212 348/222.1 |
| 2012/0284668 | A1 | 11/2012 | Bamford et al. | |
| 2013/0058019 | A1 | 3/2013 | Lee et al. | |
| 2013/0100096 | A1 | 4/2013 | Webster et al. | |
| 2013/0314448 | A1 * | 11/2013 | Toksvig | G09G 3/3426 345/690 |

FOREIGN PATENT DOCUMENTS

| | | | |
|---|---|---|---|
| CN | 102024424 | A | 4/2011 |
| CN | 102067578 | A | 5/2011 |
| CN | 102137178 | A | 7/2011 |
| CN | 102246116 | A | 11/2011 |
| CN | 102541440 | A | 7/2012 |
| KR | 20100046595 | A | 5/2010 |
| KR | 20110028357 | A | 3/2011 |
| WO | WO2010005663 | A1 | 1/2010 |

OTHER PUBLICATIONS

Machine Translation and Abstract of Chinese Publication No. CN102246116, Nov. 16, 2011, 23 pages.

Foreign Communication From a Counterpart Application, Chinese Application No. 201380046553.4, Chinese Office Action dated Sep. 30, 2017, 13 pages.

Foreign Communication From a Counterpart Application, PCT Application No. PCT/CN2013/084596, International Search Report dated Jan. 2, 2014, 6 pages.

Foreign Communication From a Counterpart Application, PCT Application No. PCT/CN2013/084596, Written Opinion dated Jan. 2, 2014, 4 pages.

Foreign Communication From a Counterpart Application, European Application No. 13843655.5, Extended European Search Report dated Aug. 24, 2015, 8 pages.

Foreign Communication From a Counterpart Application, Korean Application No. 2015-7009836, Korean Office Action dated May 23, 2016, 6 pages.

Foreign Communication From a Counterpart Application, Korean Application No. 2015-7009836, English Translation of Korean Office Action dated May 23, 2016, 5 pages.

Foreign Communication From a Counterpart Application, Chinese Application No. 201380046553.4, Chinese Search Report dated Jun. 28, 2016, 13 pages.

Foreign Communication From a Counterpart Application, Chinese Application No. 201380046553.4, Chinese Office Action dated Jun. 28, 2016, 13 pages.

Office Action dated Oct. 16, 2015, 19 pages, U.S. Appl. No. 13/633,710, filed Oct. 2, 2012.

Office Action dated May 28, 2015, 23 pages, U.S. Appl. No. 13/633,710, filed Oct. 2, 2012.

Notice of Allowance dated Apr. 22, 2016, 8 pages, U.S. Appl. No. 13/633,710, filed Oct. 2, 2012.

* cited by examiner

Bright light Environment

Low light Environment

Battery Charging

Battery Low

Spotlight

Animated Sparkle

Touch point dimple lighting

Touch point sunburst

Touch point deformation

Touch point magnification

USER INTERFACE DISPLAY COMPOSITION WITH DEVICE SENSOR/STATE BASED GRAPHICAL EFFECTS

CROSS-REFERENCE TO RELATED APPLICATIONS

This application is a continuation of U.S. patent application Ser. No. 13/633,710, filed on Oct. 2, 2012, and entitled "User Interface Display Composition with Device Sensor/State Based Graphical Effects," which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Modern mobile nodes (MNs) may be capable of executing applications, which may be downloaded from the internet or other sources and installed by a user. The explosion of available MN applications and the increasing complexity of such applications place ever more stringent demands on MN hardware and operating firmware/software. For example, a MN may comprise a display screen for displaying, among other things, visual output from applications. A user may desire to simultaneously view output from a plurality of applications or processes, which may create additional processing constraints for MN hardware.

SUMMARY

In one embodiment, the disclosure includes a method comprising receiving sensor data from a sensor, obtaining image data from a graphical effects shader based on the sensor data, blending the image data with a plurality of application surfaces to create a blended image, and transmitting the blended image to a display. The method may comprise blending the blended image with a color image to create a color-tinted blended image in response to a reduction in ambient light sensed by a light sensor.

In another embodiment, the disclosure includes a mobile node (MN) comprising a sensor configured to generate sensor data, a display device, and a processor coupled to the sensor and the device display, wherein the processor is configured to receive the sensor data, obtain image data generated by a graphical effects shader based on the sensor data, blend the image data with an application surface associated with a plurality of applications to create a blended image, and transmit the blended image to the display. The MN may further blend the blended image with a color image to create a color-tinted blended image in response to a reduction in ambient light.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts. The patent or application file contains at least one drawing executed in color. Copies of this patent or patent application publication with color drawing(s) will be provided by the Office upon request and payment of the necessary fee.

DETAILED DESCRIPTION

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is an apparatus and method of employing graphic effect shaders to display visual effects to denote MN sensor data in conjunction with application visual data. Such sensors data may include environmental, position, motion, device state, and touch detected by the MN. The MN may comprise a surface composition engine that may receive the application visual data and the sensor data, retrieve graphical effects related to the sensor data from the graphic effect shaders, combine the graphical effects with the application visual data into an image, and transmit the image to the MN's display for viewing by the user.

Figure 1:
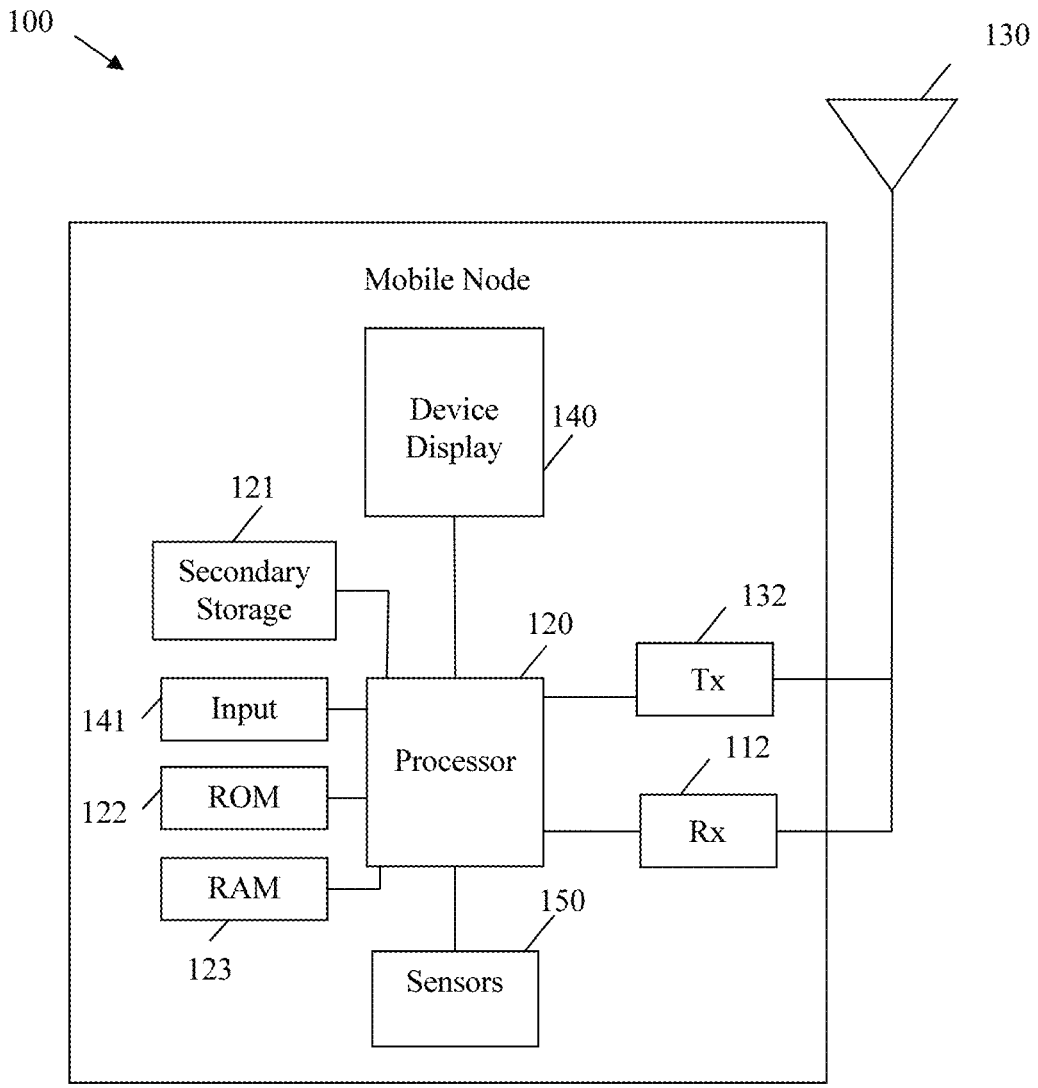
FIG. 1 is a schematic diagram of an embodiment of a MN.

FIG. 1 is a schematic diagram of an embodiment of a MN 100. MN 100 may comprise a two-way wireless communication device having voice and data communication capabilities. In some aspects, voice communication capabilities are optional. The MN 100 generally has the capability to communicate with other computer systems on the Internet. Depending on the exact functionality provided, the MN 100 may be referred to as a data messaging device, a two-way pager, a wireless e-mail device, a cellular telephone with data messaging capabilities, a wireless Internet appliance, a wireless device, a smart phone, a mobile device, or a data communication device, as examples.

MN 100 may comprise a processor 120 (which may be referred to as a central processor unit or CPU) that is in communication with memory devices including secondary storage 121, read only memory (ROM) 122, and random access memory (RAM) 123. The processor 120 may be implemented as one or more CPU chips, one or more cores (e.g., a multi-core processor), or may be part of one or more application specific integrated circuits (ASICs) and/or digital signal processors (DSPs). The processor 120 may be configured to implement any of the schemes described herein, and may be implemented using hardware, software, firmware, or combinations thereof.

The secondary storage 121 may be comprised of one or more solid state drives, disk drives, and/or other memory types and is used for non-volatile storage of data and as an over-flow data storage device if RAM 123 is not large enough to hold all working data. Secondary storage 121 may be used to store programs that are loaded into RAM 123 when such programs are selected for execution. The ROM 122 may be used to store instructions and perhaps data that are read during program execution. ROM 122 may be a non-volatile memory device may have a small memory capacity relative to the larger memory capacity of secondary storage 121. The RAM 123 may be used to store volatile data and perhaps to store instructions. Access to both ROM 122 and RAM 123 may be faster than to secondary storage 121.

The MN 100 may communicate data (e.g., packets) wirelessly with a network. As such, the MN 100 may comprise a receiver (Rx) 112, which may be configured for receiving data (e.g. internet protocol (IP) packets or Ethernet frames) from other components. The receiver 112 may be coupled to the processor 120, which may be configured to process the data and determine to which components the data is to be sent. The MN 100 may also comprise a transmitter (Tx) 132 coupled to the processor 120 and configured for transmitting data (e.g. the IP packets or Ethernet frames) to other components. The receiver 112 and transmitter 132 may be coupled to an antenna 130, which may be configured to receive and transmit wireless radio frequency (RF) signals.

The MN 100 may also comprise a device display 140 coupled to the processor 120, for displaying output thereof to a user. The MN 100 and the device display 140 may configured to accept a blended image, as discussed below, and display it to a user. The device display 120 may comprise a Color Super Twisted Nematic (CSTN) display, a thin film transistor (TFT) display, a thin film diode (TFD) display, an organic light-emitting diode (OLED) display, an active-matrix organic light-emitting diode (LED) display, or any other display screen. The device display 140 may display in color or monochrome and may be equipped with a touch sensor based on resistive and/or capacitive technologies.

The MN 100 may further comprise an input device 141 coupled to the processor 120, which may allow the user to input commands to the MN 100. In the case that the display device 140 comprises a touch sensor, the display device 140 may also be considered the input device 141. In addition to and/or in the alternative, an input device 141 may comprise a mouse, trackball, built-in keyboard, external keyboard, and/or any other device that a user may employ to interact with the MN 100. The MN 100 may further comprise sensors 150 coupled to the processor 120, which may detect conditions in and around the MN 100, examples of which are discussed in further detail in conjunction with FIG. 5.

Figure 2:
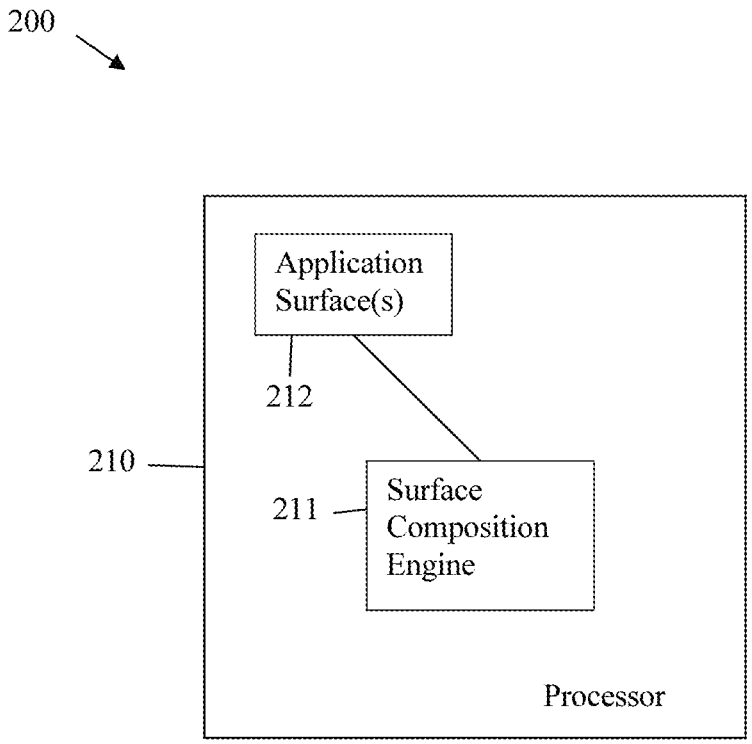
FIG. 2 is a schematic diagram of an embodiment of MN display mechanism.

FIG. 2 is a schematic diagram of an embodiment of MN display mechanism 200. The display mechanism 200 may be implemented on processor 210, which may be substantially similar to processor 120 and may be employed to generate visual and/or graphical data for transmission to a device display 120 for viewing by the user. The processor 210 may also be configured to execute a plurality of applications. The applications may be implemented in software, firmware, hardware, or combinations thereof, and may be designed to function on a specific model of MN, a group of related MN models, or any MN. The applications may respond to user input, accepted by the MN, and may output visual and/or auditory data for output to the user. Such applications may be executed and/or processed substantially simultaneously.

One embodiment of the processor 210, for example a graphics processing unit (GPU) or other specific processor(s), may comprise a plurality of application surfaces 212 and a surface composition engine 211. An application surface 212 may be visual data created by an active application. An application surface 212 may comprise a single image or a plurality of images and may be associated with a single application or a plurality of applications. An application surface 212 may be transmitted between processors 210, in the case of a plurality of processors, or generated by a single processor 210. In an alternative embodiment, the surface composition engine 211 may be implemented by dedicated hardware, such as a separate general graphic co-processor connected to a processor. In an alternative embodiment, the plurality of application surfaces 212 and the surface composition engine 211 are implemented by software which are stored in the memory or storage and can be executed on a processor. The application surface 212 may be transmitted to the surface composition engine 211 for display. The surface composition engine 211 may combine the visual data from the application surface 212 into a single blended image that complies with any display requirements imposed by the MN or by the application and transmit the blended image to a connected device display.

Figure 3:
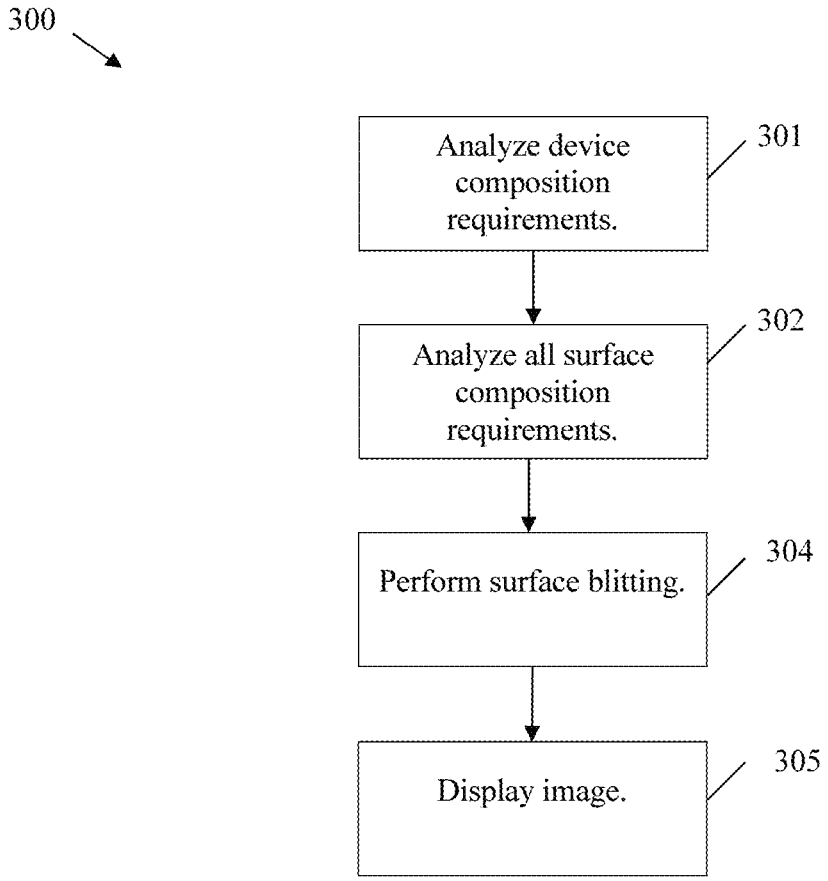
FIG. 3 is a flowchart of an embodiment of a method of displaying MN application output.

FIG. 3 is a flowchart of an embodiment of a method 300 of displaying MN application output. At step 301, the surface composition engine may analyze device composition requirements. Such requirements may comprise surface order, position, depth, blending, and transparency requirements. For example, the device composition requirements may indicate to the surface composition engine which application surfaces should be displayed, the position of each application surface on the display, the ordering the of the applications surfaces (e.g. which surfaces should be displayed when more than one surface occupies the same pixel), the blending operations required, and the amount of transparency (if any) to be used when blending. Upon completion of step 301, the surface composition engine may proceed to step 302 and analyze all surface composition requirements. For example, the surface composition engine may receive visual data from the active application surfaces, determine the rotation of each application surface, the scale of each surface, determine whether shearing of an application surface is needed, any needed reflection effects, projection effects, and any blending requirements related to specific application surfaces. Upon determining all relevant composition and application surface requirements, the surface composition engine may proceed to step 304 and perform the surface blitting. The surface composition engine may compose the application surfaces to be displayed in a back to front order and blit the application surfaces into a single image by employing a specified blending algorithm. The surface composition engine may then proceed to step 305 and cause the blended image to be displayed by transmitting the blended image to a connected device display.

Figure 4:
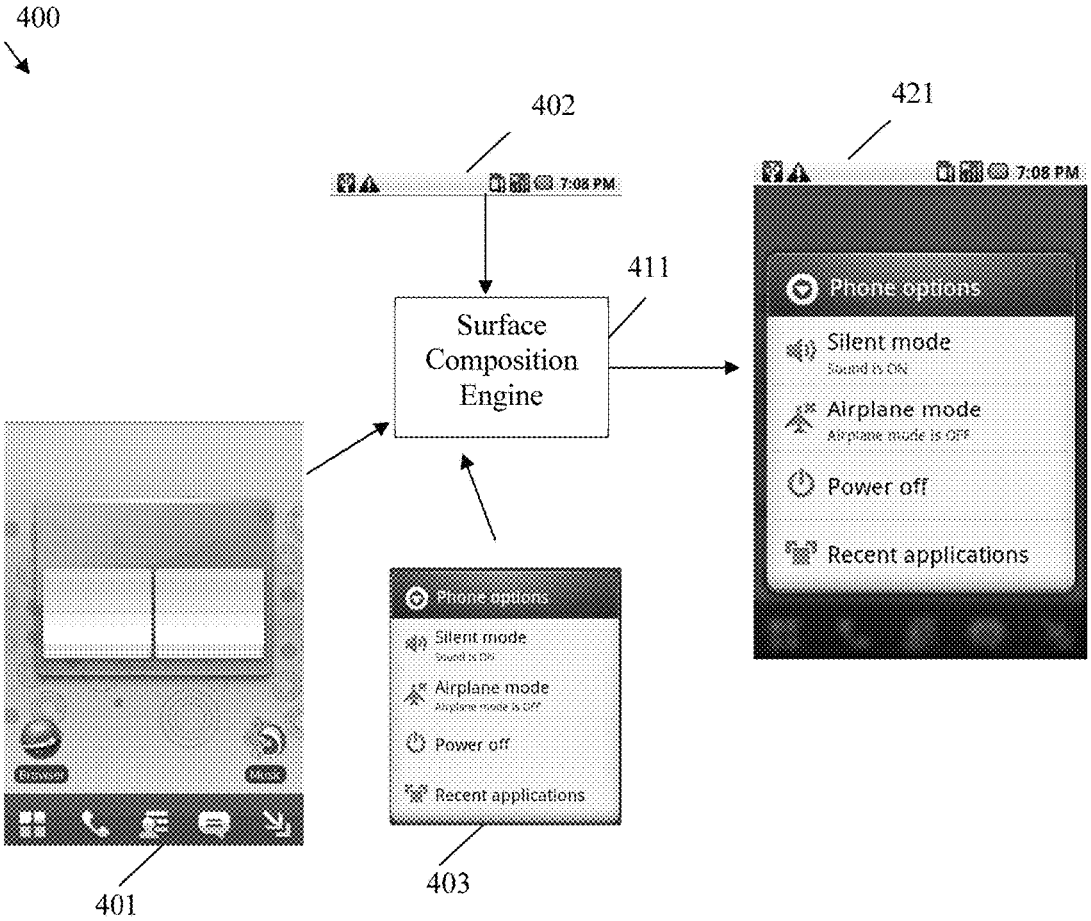
FIG. 4 is a schematic diagram of an example of MN application pixel blitting.

FIG. 4 is a schematic diagram of an example of MN application pixel blitting 400. Blitting may be a computer graphics operation that blends a plurality of bitmaps into a single image using a raster operation. Visual data 401-403 may comprise applications surfaces (e.g. application surface 212) generated by various applications being processed by a MN at a specified time. The visual data 401-403 may be blended by a surface composition engine 411 which may be substantially similar to 211. Blending the visual data 401-

403 may result in blended image 421. The blitting operation may blend the visual data 401-402 into the blended image 421 by treating each image as a layer. Where the image layers share the same pixels, the blitting operation may display only the data from the topmost layer. In addition or in the alternative, the blending operation may combine characteristics of various layers. For example, blending may comprise applying a color, surface pixel sampling, or other graphical effect from a first layer to an image from a second layer.

Figure 5:
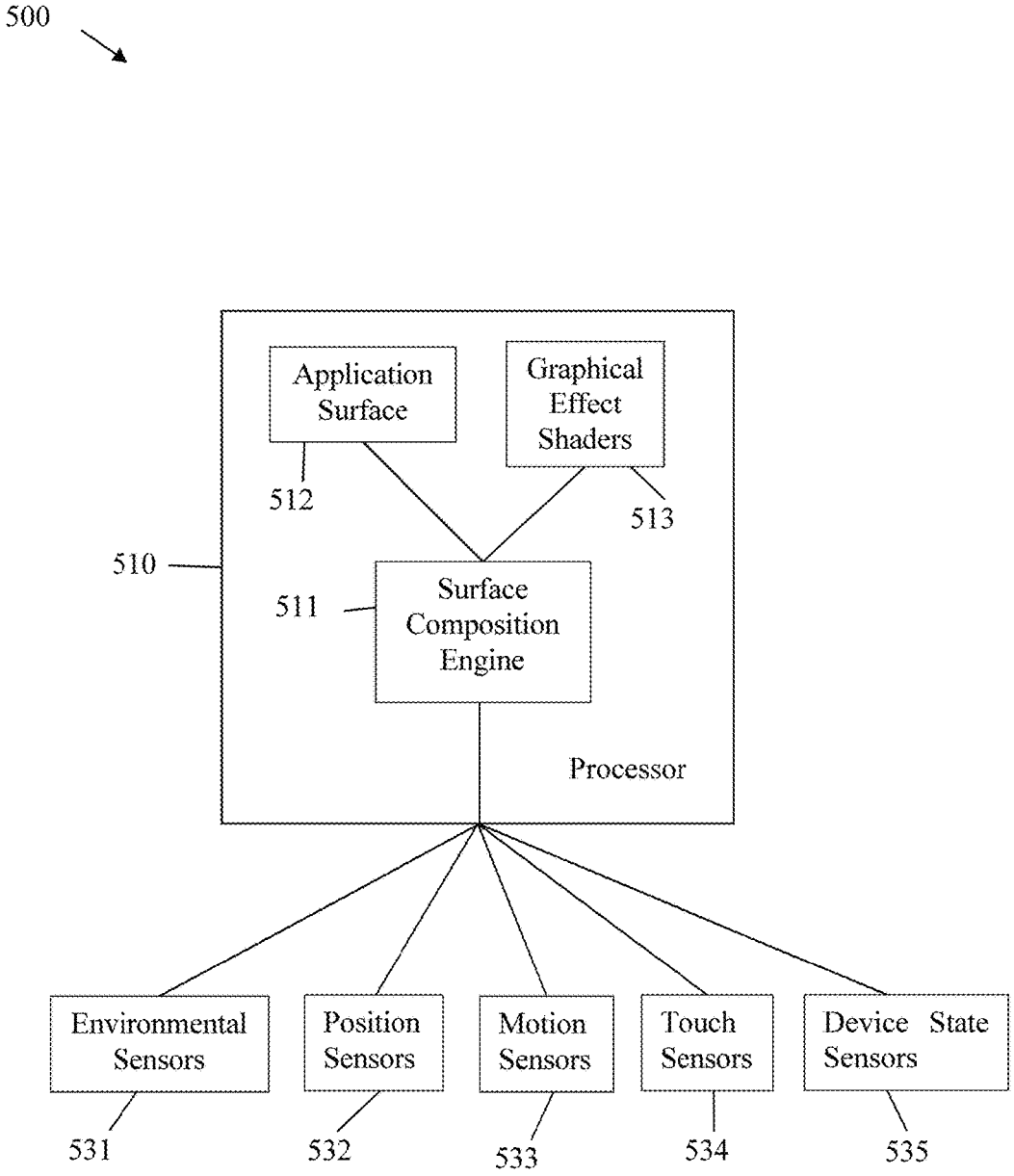
FIG. 5 is a schematic diagram of an embodiment of another MN display mechanism.

FIG. 5 is a schematic diagram of an embodiment of another MN display mechanism 500. Display mechanism 500 may be substantially the same as display mechanism 200, but may comprise a processor 510, for example a GPU or other specific processor(s), which may comprise graphical effects shaders 513 and connected sensors 531-535. The surface composition engine 511 may accepts input from sensors 531-535, obtain image data from the graphical effects shaders 513 related to the sensor 531-535 input, and blend (e.g. via blitting) the image data from the graphical effects shaders 513 with visual data from the applications surface 512. The blended image may be transmitted to a connected device display for display to a user. The process of blending the image data from the graphical effects shaders 513 with the application surface 512 data may allow the MN to globally display graphical effects related to the MN's current state/sensor data without requiring the applications to accept or even be aware of such state/sensor data.

In an alternative embodiment, the graphical effect shaders 513, like the surface composition engine 511, may be implemented by dedicated hardware, such as a separate graphic coprocessor connected to a processor. In an alternative embodiment, graphical effect shaders 513 and the surface composition engine 511 are implemented by software which are stored in the memory or storage and can be executed on a processor. The graphical effect shaders 513 may comprise a single shader or a plurality of shaders. The graphical effect shaders 513 may be configured to produce a large number of visual effects, for example images of light halos, cracks, fires, frozen water, bubbles, ripples, heat shimmer, quakes, shadows, and other images and/or image distortions. The preceding list of visual effects is presented to clarify the general nature of effects that may be produced and should not be considered limiting. The graphical effect shaders 513 may produce a static visual effect over a specified period of time, a set of images over time to produce an animated effect, and/or combine multiple effects. The graphical effect shaders 513 may accept input from the surface composition engine 511, may generate image data representing a visual effects requested by the surface composition engine 511, and may transmit the image data to the surface composition engine 511 for blending and display.

The sensors 531-535 may include any sensors installed on a MN that may alert the MN to a condition or change in condition at a specified time. For example, environmental sensors 531 may indicate the environmental conditions inside of or in close proximity to the MN. Environmental sensors 531 may comprise light sensors, temperature sensors, humidity sensors, barometric pressure sensors, etc. Position sensors 532 may detect that indicates the position of the MN relative to external objects. Position sensors 532 may comprise location sensors, such as global position system (GPS) sensors, magnetic field sensors, orientation sensors, proximity sensors, etc. For example, the position sensors 532 may provide data to allow the processor 510 to determine the MN's orientation relative to the ground and/or relative to the user, the MNs distance from the user and/or other transmitting devices, the MNs geographic location, the MNs elevation above/below sea level, etc. Motion sensors 533 may detect by the type and intensity of motion experienced by the MN and may comprise, for example, an accelerometer, a gravity sensor, a gyroscope, etc. Touch sensors 534, such as capacity and/or resistive touch screens and the like, may indicate whether and how a user is touching the MN or a specific portion thereof. Device state sensors 535 may detect the state of the MN at a designated time. For example, device state sensors 535 may comprise a battery state sensor, a haptics state sensor that measures the activity of an MN's vibration system, an audio state sensor, etc.

As discussed above, the sensors 531-535 may transmit sensor data to the processor 510 indicating various state and environmental data related to the MN. The sensor data may indicate the current state of the MN and or/the environment around the MN, a change in MN state or in the MN's environment, and/or combinations thereof. The processor 510 and/or surface composition engine 511 may be configured to interpret the sensor data and may request a graphical effect from the graphical effect shader 513 based on the sensor data. The processor 510 and/or surface composition engine 511 may blend image data from the graphical effect shader 513 with visual data from the application surface 512 and may transmit the blended image to a connected device display. For example, the MN may be configured to distort the displayed image in a location touched by a user. The MN may also be configured to blend compass data with the image data, which may result in the image of a compass that moves based on MN position and/or facing. As another example, the device display may display a water ripple effect (e.g. image data may appear to move in a manner similar to water experiencing waves) when a user shakes the MN. The device display may appear to burn when the MN experiences a high temperature or freeze when the MN experiences low temperatures. The displayed image may appear to vibrate simultaneously with the MNs vibrating feature or dim and spotlight portions of an application at night. These and many other graphical effects may be initiated in response to sensor data from sensors 531-535. The graphical effects employed and the selection of sensor data that initiates the blending operation may be pre-programmed by the MN manufacturer, programmed into the MN's operating system, downloaded by the user, etc. The graphical effects and any triggering sensor data conditions that initiate the blending operation may also be enabled, disabled, and customized by the user.

Figure 6:
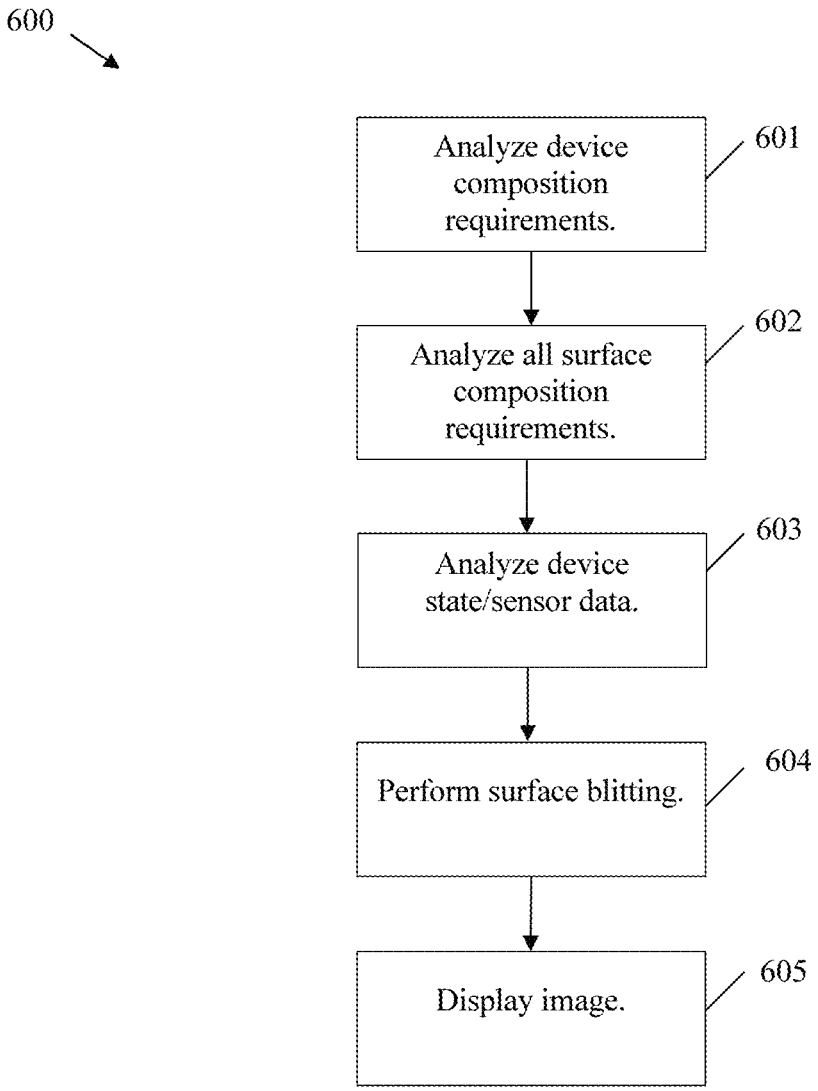
FIG. 6 is a flowchart of an embodiment of another method of displaying MN application output.

FIG. 6 is a flowchart of an embodiment of another method 600 of displaying MN application output. Steps 601, 602, 604, and 605 may be substantially similar to steps 301, 302, 304, and 305. However, at step 602, the surface composition engine may proceed to step 603. At step 603, the surface composition engine may receive sensor and/or state data from MN sensors connected to the processor. The surface composition engine may determine if any graphical effects may be required in response to the sensor data, and may request a graphical effect shader provide the corresponding image data. Upon receiving the image data from the graphical effect shader, the surface composition engine may determine the display regions that will be impacted by the effects in the image date and proceed to step 604. In step 604, the surface composition engine may apply the graphical effects in the image data as part of the blitting process performed in step 304. For example, the graphical effects may impact pixel colors, nature of the blending, and surface pixel sampling associated with the blended image. The blended image may then be displayed at 605.

Figure 7:
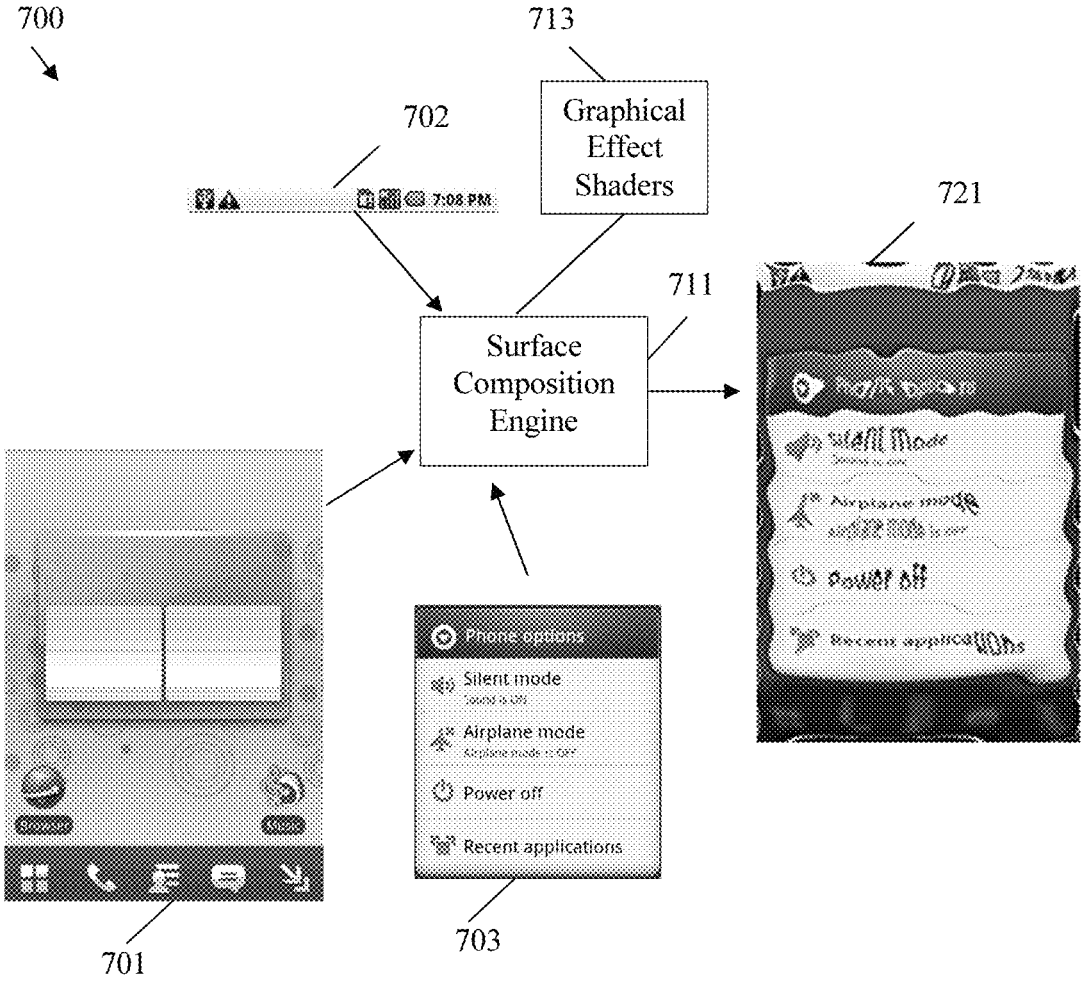
FIG. 7 is a schematic diagram of another example of MN application pixel blitting.
Figure 8:
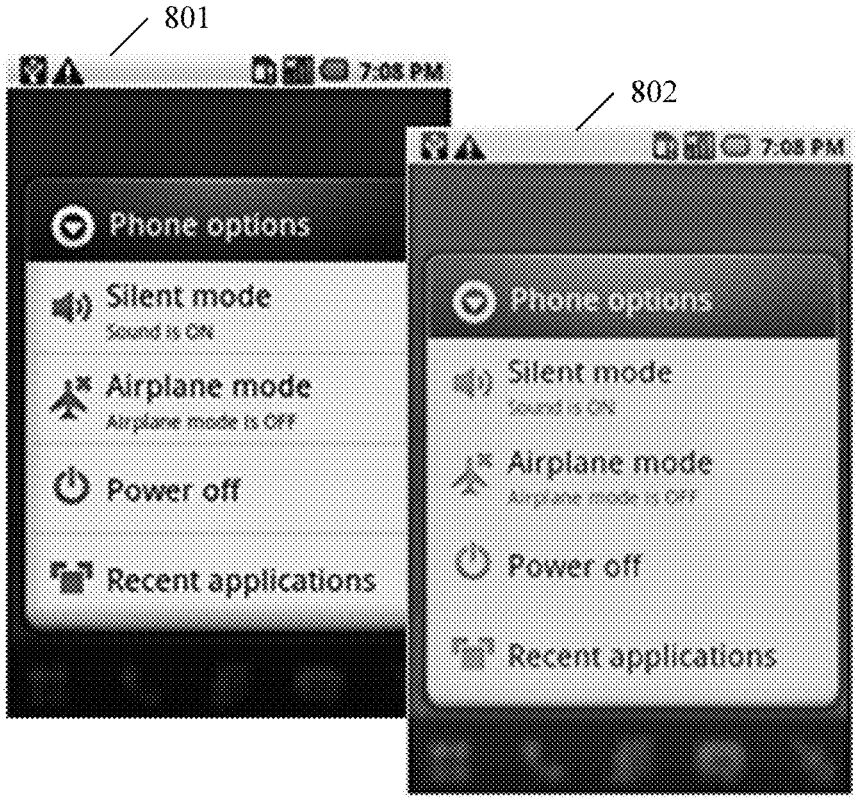
FIGS. 8-13 are examples of embodiments of the results of application pixel blitting.
Figure 9:
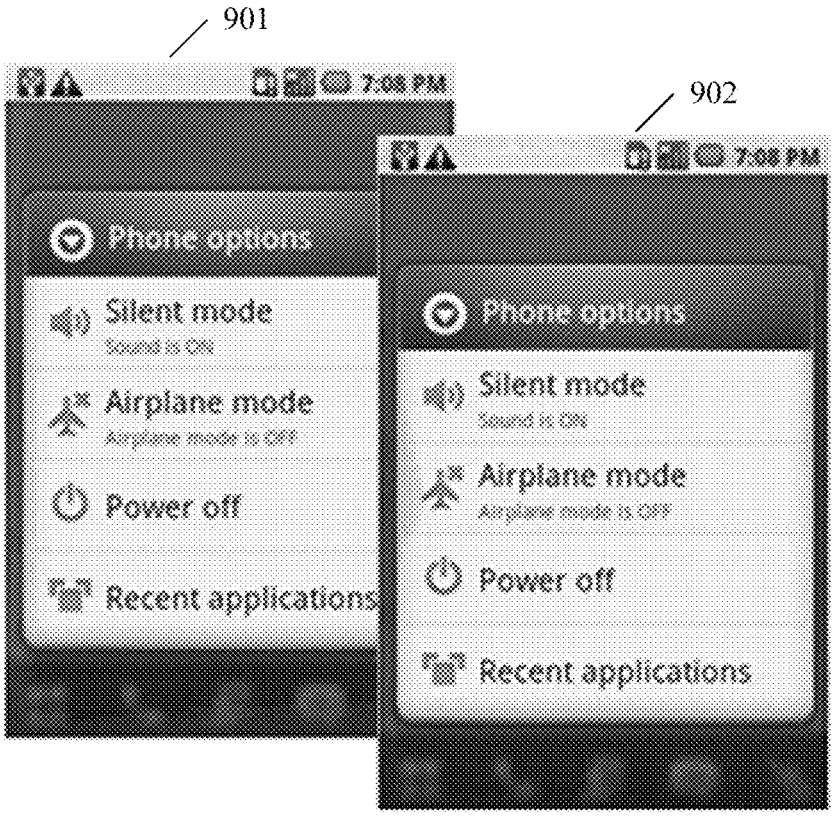
Figure 10:
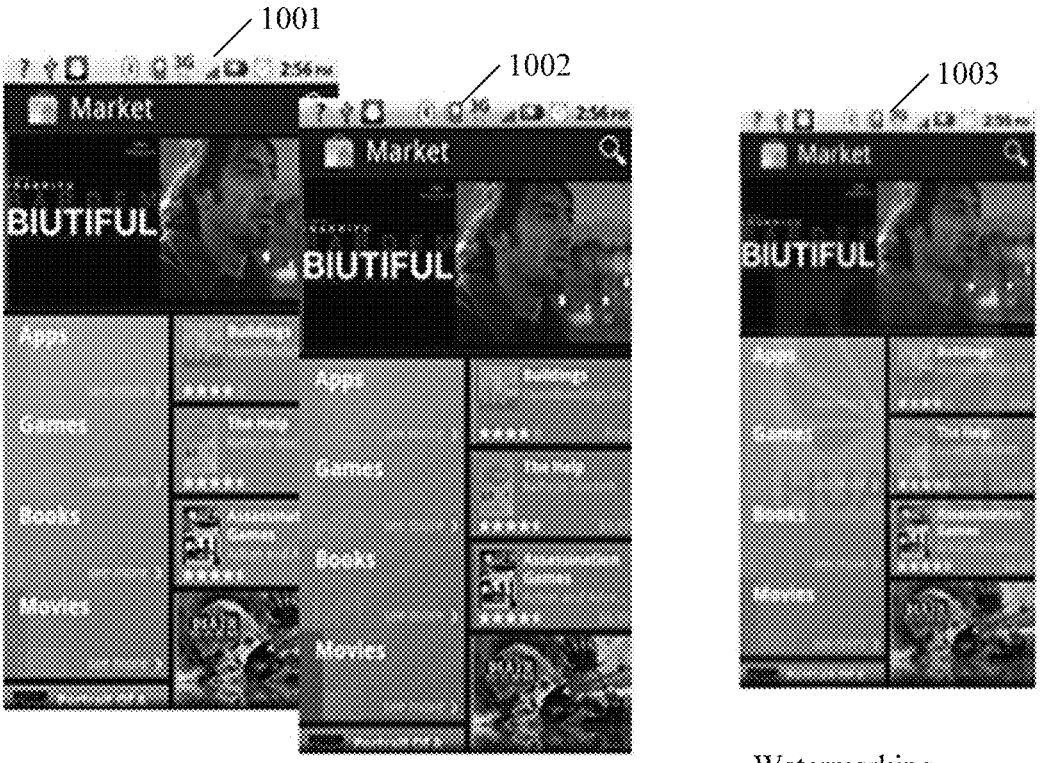
Figure 11:
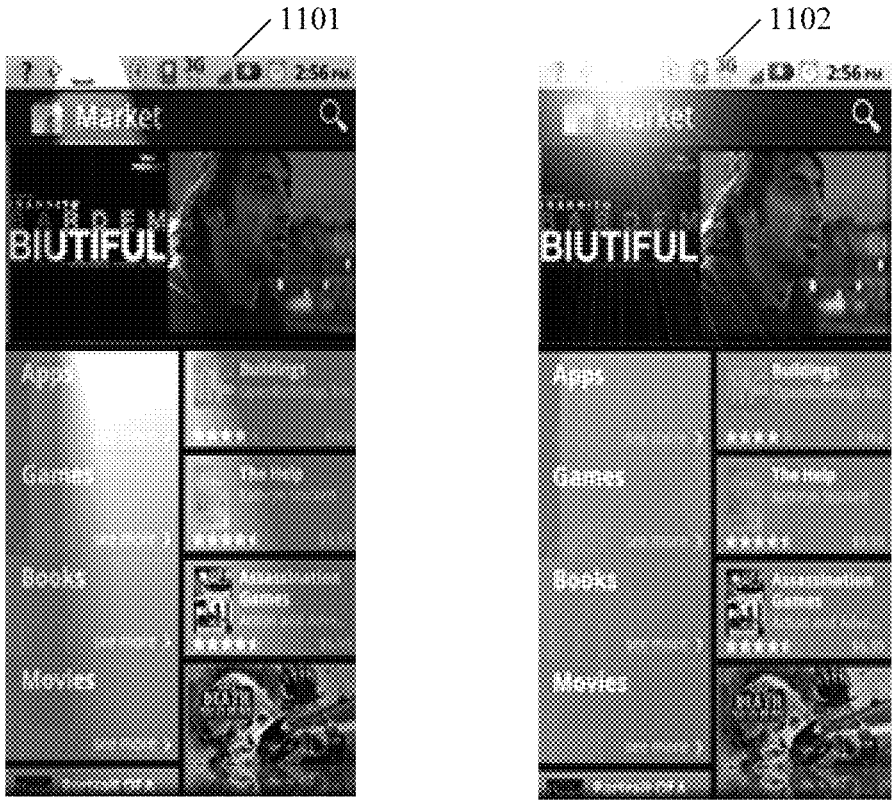
Figure 12:
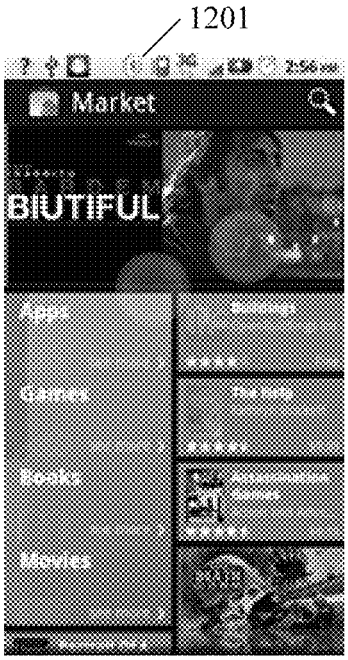
Figure 12:
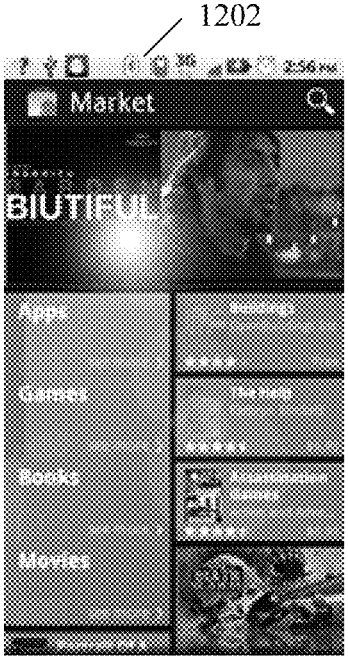
Figure 13:
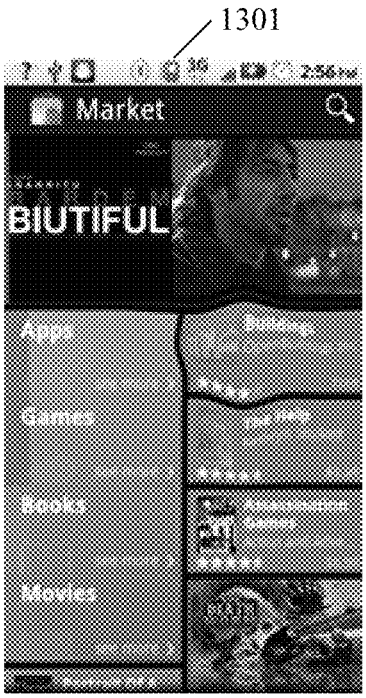
Figure 13:
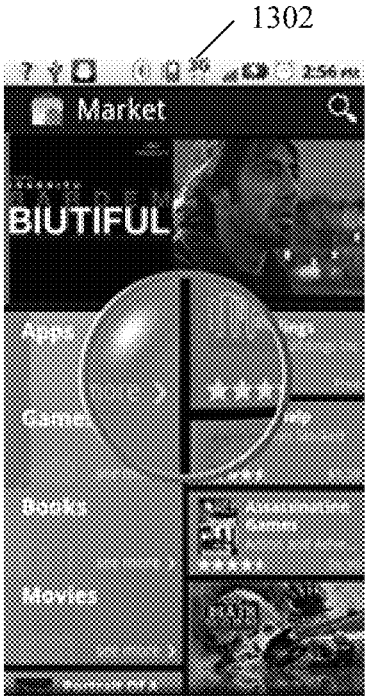

FIG. 7 is a schematic diagram of another example of MN application pixel blitting 700. Application pixel blitting 700 may be substantially the same as pixel blitting 400. However, the surface composition engine 711 may be coupled to graphical effects shaders 713. The surface composition engine 711 may receive MN sensor data from sensors, such as 531-535, obtain image data from the graphical effects shaders 713 in response to the sensor data, and blend the image data from the graphical effects shaders 713 with visual data 701-703. For example, the surface composition engine 711 may complete the blending via method 600. Blended image 721 may be the image that results from blending the image data from the graphical effects shaders 713 with visual data 701-703. Blended image 721 may be displayed statically or displayed in animated fashion based on changing image data from the graphical effects shaders 713. For example, the surface composition engine 711 may receive MN sensor data from a haptics state sensor (e.g. device state sensor 535) indicating the MN is vibrating, perhaps due to an incoming call. The surface composition engine 711 may request image data from the graphical effects shaders 713 that is associated with an image distortion and perform the blending operation according. From the user's standpoint, the MN display, which may be displaying blended image 721, may appear to ripple and/or vibrate along with the vibration of the MN.

FIGS. 8-13 are example embodiments of the results of application pixel blitting 700. Blended images 801-802, 901-902, 1001-1003, 1101-1102, 1201-1202, and 1301-1302 may all be produced substantially similarly to blended image 721. Blended image 801 may be the result of blending multiple application surfaces (e.g. visual data) without the use of graphical effects. Blended image 802 may be a green tinted image that may result from blending blended image 801 with a green image. Blended image 801 may be displayed when an MN is in an environment with bright ambient light while blended image 802 may be displayed when a light sensor (e.g. environmental sensor 531) detects that the MN has entered a low ambient light environment. The green tint of 802 may be more easily viewed in a low light environment than blended image 801 although red and other colors may be used.

Blended images 901-902 may be substantially the same as blended image 801. However, blended image 901 may comprise a green border and blended image 902 may comprise a red border, resulting from blending image 801 with an image of a green border and an image of a red border, respectively. Blended image 901 and blended image 902 may be displayed to indicate to the user that the MN battery is being charged and that the MN battery is low, respectively, based on MN sensor data from a battery state sensor (e.g. 535). While green and red borders are employed in blended images 901-902, any colors may be used.

Blended images 1001, 1002, and 1003 may be the results of a blue color theme, a neon color theme, and a watermarking overlay, respectively. Blended image 1001 may comprise blue sections and may be the result of blending an image of application surface(s) (e.g. visual data) with image data comprising a color modifier. A color value modifier may be data that may be used to map a first color to a second color. The color value modifier may be used to convert all instances of gray color values to blue color values. Blended image 1002 may be substantially similar to blended image 1001, but all colors may appear to be bright neon. Blended image 1002 may result from globally applying a color value modifier to all color values of an image of application surface(s) using a blending operation. Blended image 1003 may be substantially similar to Blended image 1001-1002 without any color change to the application surface image. Instead, blended image 1003 may comprise a watermark that results from blending an application surface image with an image of the watermark. Blended images 1001-1003 may be displayed in response to sensor data, such as geo-location. For example, blended image 1001 may be displayed when the MN is over a body of water, blended image 1002 may be displayed when the MN is in an urban area, and blended image 1003 may be displayed when the MN is near the office of a company associated with the watermark.

Blended images 1101 and 1102 may comprise a spotlight and an animated sparkle, respectively. Blended image 1101 may be the result of blending an image of application surface(s) with an image of a bright spotlight that originates from the top of the image with a small dense concentration of light and extends toward the bottom of the image with a progressively less dense concentration that covers a progressively larger area. Blended image 1102 may display a single frame of an animated sparkle. The sparkle may appear in one configuration at a first time and a second configuration at a second time causing the display to appear animated. Blended images 1101-1102 may be displayed in response to sensor data, such as changes in ambient light.

Blended images 1201 and 1202 may comprise dimple lighting and a sunburst, respectively. Blended image 1201 may comprise two substantially circular points of light separated by a space. Blended image 1202 may comprise a substantially circular primary point of light with dimmer circles of light extending down the display. Blended images 1201 and 1202 may be created using the blending operations discussed above and may be displayed in response sensor data from a touch sensor. For example, blended image 1201 may position the points of light on either side of a point of the display touched by a user. Alternatively, each light point may be positioned under a plurality of points of the display touched by the user. As another example, blended image 1202 may position the primary point of light at the point of the display touched by the user, and the dimmer circles may maintain a position relative to the primary point of light. As yet another example, blended images 1201-1202 may be created in response to sensor data from multiple sensors, such as the touch sensor and the light sensor. In this case, the lighting effects of blended images 1201-1202 may only be displayed when ambient light near the MN drops below a certain level, allowing the user to provide additional illumination to portions of the display that are of particular interest.

Blended images 1301 and 1302 may display deformation and magnification of particular portions of the display, respectively, based on a touch sensor. Specifically, blended image 1301 may deform the image at a point of the display touched by a user. For example, blended image 1301 may show animated ripples that appear like water around the point of the display touched by the user. Other deformations may cause the image to appear to react to user touch in a manner similar to a gas or a solid of varying degrees of firmness. Blended image 1302 may comprise a circular ring bounding a mostly transparent image that appears to be a magnifying glass. The blending operation may also deform the underlying visual data by stretching the image outward from the center of the magnifying glass, for example using vector operations. As a result, the magnifying glass image may appear to enlarge the portion of the image over which the magnifying glass is located. The magnifying glass may then move across the display based on user touch detected by the touch sensor. In blended images 1301-1302 all deformities may be centered on the location of the display touched by the user, as sensed by the touch sensor. Each of blended images 801-802, 901-902, 1001-1003, 1101-1102, 1201-1202, and 1301-1302 may allow the user of the MN to interact with the display results without directly interacting with the applications creating the underlying visual data.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 7 percent, . . . , 70 percent, 71 percent, 72 percent, . . . , 97 percent, 96 percent, 97 percent, 98 percent, 99 percent, or 100 percent. Moreover, any numerical range defined by two R numbers as defined in the above is also specifically disclosed. The use of the term "about" means±10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystem shaders, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A method comprising:

receiving sensor data from a light sensor;

obtaining image data from a graphical effects shader based on the sensor data;

blending the image data with a plurality of application surfaces to create a blended image;

blending the blended image with a color image to create a color-tinted blended image in response to a change in ambient light sensed by the light sensor; and transmitting the color-tinted blended image to a display.

2. The method of claim 1, wherein the color image comprises a green color.

3. The method of claim 1, wherein the color image comprises a colored border, and wherein the color-tinted blended image comprises color-tinted borders.

4. The method of claim 3, wherein a color of the colored border is selected in response to a change in battery state sensed by a battery state sensor.

5. The method of claim 1 further comprising obtaining composition requirements of a mobile node (MN), composition requirements of an application that provides an application surface, or combinations thereof, and wherein blending the image data with the application surfaces is performed to meet the MN's composition requirements, the application's composition requirements, or combinations thereof.

6. The method of claim 1 further comprising identifying display regions impacted by the image data prior to blending the image data with the application surfaces.

7. The method of claim 1, wherein the image data and application surfaces each comprise bitmaps.

8. The method of claim 7, wherein blending the image data with the application surfaces to create the blended image comprises pixel blitting.

9. The method of claim 1, wherein the application surfaces are generated by a plurality of applications.

10. The method of claim 1, wherein blending the image data with the application surfaces to create the blended image changes pixel colors, blending, or surface pixel sampling of the application surfaces.

11. The method of claim 1, wherein the application surfaces are generated by a process that is not configured to receive sensor data.

12. The method of claim 1, further comprising receiving touch sensor data from a touch sensor, wherein the blended image comprises two substantially circular points of light separated by a space or a substantially circular primary point of light, and wherein the points of light are positioned on the application surfaces in response to user touch sensed by the touch sensor.

13. The method of claim 1, further comprising receiving touch sensor data from a touch sensor, wherein the blended image comprises the application surfaces deformed by the image data, and application surface deformities are positioned in response to user touch sensed by the touch sensor.

14. A mobile node (MN) comprising:

a light sensor configured to generate sensor data;

a display device; and a processor coupled to the light sensor and the device display, wherein the processor is configured to:

receive the sensor data from the light sensor;

obtain image data generated by a graphical effects shader based on the sensor data;

blend the image data with an application surface associated with a plurality of applications to create a blended image;

blend the blended image with a color image to create a color-tinted blended image in response to a change in ambient light sensed by the light sensor; and transmit the color-tinted blended image to the display device.

15. The MN of claim 14, wherein the color image comprises a green color.

16. The MN of claim 14, wherein the color image comprises a colored border, and wherein the color-tinted blended image comprises color-tinted borders.

17. The MN of claim 16, wherein a color of the colored border is selected in response to a change in battery state sensed by a battery state sensor.

18. The MN of claim 14, wherein the sensor comprises an environmental sensor that indicates environmental conditions inside of or in close proximity to the MN, and wherein obtaining image data generated by the graphical effects shader comprises requesting image data from the graphical effects shader based on the environmental conditions measured by the environmental sensor.

19. The MN of claim 18, wherein the environmental sensor further comprises a temperature sensor, a humidity sensor, a barometric pressure sensor, or combinations thereof.

20. The MN of claim 14, wherein the application surface is generated by a process that is not configured to receive sensor data.

* * * * *